US006066425A

United States Patent [19]

Ferrar et al.

[11] Patent Number: 6,066,425

[45] **Date of Patent: *May 23, 2000**

[54] ELECTROPHOTOGRAPHIC CHARGE GENERATING ELEMENT CONTAINING PRIMER LAYER

[75] Inventors: Wayne T. Ferrar, Fairport; Louis J. Sorriero, Rochester; J. Robin Cowdery, Webster; David S. Weiss, Rochester, all of N.Y.

[73] Assignee: Eastman Kodak Company, Rochester, N.Y.

[ * ] Notice: This patent is subject to a terminal disclaimer.

[21] Appl. No.: 09/222,639

[22] Filed: Dec. 30, 1998

[51] Int. Cl.[7] ..... G03G 5/047; G03G 5/087; G03G 5/147

[52] U.S. Cl. ..... 430/58.1; 430/58.2; 430/66; 430/67; 428/195

[58] Field of Search ..... 430/66, 67, 58.1, 430/58.2; 428/195

[56] References Cited

U.S. PATENT DOCUMENTS

| | | | |
|---|---|---|---|
| 4,197,335 | 4/1980 | Goossens | 427/162 |
| 4,210,699 | 7/1980 | Schroeter et al. | 428/331 |
| 4,239,798 | 12/1980 | Schroeter et al. | 428/331 |
| 4,407,920 | 10/1983 | Lee et al. | 430/66 |
| 4,595,602 | 6/1986 | Schank | 430/76 |
| 5,693,442 | 12/1997 | Weiss et al. | 430/66 |
| 5,731,117 | 3/1998 | Ferrar et al. | 430/66 |

*Primary Examiner*—Janis L. Dote
*Attorney, Agent, or Firm*—J. Lanny Tucker

[57] ABSTRACT

Electrophotographic charge generating elements comprise a solid electrolyte layer having improved image discrimination and layer adhesion. The solid electrolyte layer includes a complex of a silsesquioxane and a charge carrier, and is adhered to an underlying photoconductor layer using a primer layer that includes specific addition polymers. This primer layer has a resistivity of at least $10^{10}$ ohms/square and contains substantially no free ACTIVE moieties as defined herein. Such groups, when present in the primer layer, appear to reduce image discrimination.

23 Claims, 1 Drawing Sheet

ELECTROPHOTOGRAPHIC CHARGE GENERATING ELEMENT CONTAINING PRIMER LAYER

FIELD OF THE INVENTION

This invention relates to electrophotographic charge generating elements containing a silsesquioxane (siloxane polymer) in an overcoat or solid electrolyte layer and a vinyl primer layer. This invention is particularly useful in the field of electrophotography.

BACKGROUND OF THE INVENTION

Charge transporting elements generally comprise a support and a charge transport layer across which charge moves under certain conditions. Charge transporting elements include electrophotographic charge generating elements.

In the use of such charge generating elements (also known as electrophotographic elements), incident light induces a charge separation across the various layers of the element. The electron and hole of an electron-hole pair produced within a charge generating layer separate and move in opposite directions to develop a charge between an electrically conductive layer and an opposite surface of the element. The charge forms a pattern of electrostatic potential (also referred to as an electrostatic latent image). The electrostatic latent image can be formed by a variety of means, for example, by imagewise radiation-induced discharge of a uniform potential previously formed on the surface. Typically, the electrostatic latent image is then developed into a toner image by contacting the latent image with an electrographic developer and the toner image is then fused to a receiver material. If desired, the latent image can be transferred to another surface before development or the toner image can be transferred before fusing.

The requirements of the process of generating and separating charge place severe limitations on the characteristics of the layers in which charge is generated and holes and/or electrons are transported. For example, many such layers are very soft and subject to abrasion. This places severe constraints upon the design of charge generating elements. Some configurations cannot provide a reasonable length of service unless an abrasion resistant overcoat layer (also known as "overcoat") is provided over the other layers of the element. This presents its own problems since charge must be able to pass through the overcoat.

The resistivity of an overcoat has major consequences in an electrophotographic system. If the overcoat has high resistivity, the time constant for voltage decay will be excessively long relative to the processing time for the electrophotographic element and the overcoat will retain a residual potential after photodischarge of the underlying photoreceptor. The magnitude of the residual potential depends upon the initial potential, the dielectric constants of the various layers, and the thickness of each layer.

A solution to this problem has been to reduce the thickness of the overcoat. Another solution is to provide an overcoat that is conductive. The overcoat must, however, not be too conductive. The electrophotographic element must be sufficiently electrically insulating in the dark that the element neither discharges excessively nor allows an excessive migration of charge along the surface of the element. An excessive discharge ("dark decay") would prevent the formation and development of the electrostatic latent image. Excessive migration causes a loss of resolution of the electrostatic image and the subsequent developed image. This loss of resolution is referred to as "lateral image spread" (evidenced as "image width"). The extent of image degradation will depend upon processing time for the electrophotographic element and the thickness and resistivities of the layers. It is thus desirable to provide an overcoat that is neither too insulating nor too conductive.

Silsesquioxanes are siloxane polymers, sometimes represented by the formula $(RSiO_{1.5})_z$, that are commonly prepared by the hydrolysis and condensation of trialkoxysilanes. Some of the polymers have been modified by the inclusion of polyethers or polydialkyloxysilanes. Generally, coatings of such materials are between 0.5 to 10 $\mu$m thick and are applied from aqueous alcohol solvent systems. They have been commercially available from a number of sources for years (for example from Dow Corning, General Electric and Optical technologies). A number of patents describe the use of such polymers to provide abrasion-resistant coatings for various purposes [see for example U.S. Pat. No. 4,027,073 Clark), U.S. Pat. No. 4,159,206 (Armbuster et al), U.S. Pat. No. 4,277,287 (Frye), U.S. Pat. No. 4,324,712 (Vaughn, Jr.), U.S. Pat. No. 4,407,920 (Lee et al) and U.S. Pat. No. 4,923,775 (Schank)]. Typical uses of such polymers include scratch resistant coatings on acrylic lenses, photoreceptors and transparent glazing materials, and as overcoats for electrophotoconductive elements. For example, U.S. Pat. No. 4,159,206 (noted above) describes the use of neutral-charged, durable coating compositions that include colloidal silica and a mixture of dialkyldialkoxysilanes and alkyltrialkoxysilanes in a methanol/water solvent system. The mixture of silanes is believed to react to form silsesquioxanes.

Solid electrolytes (also known as solid ionic conductors) are solid materials in which electrical conductivity is provided by the motion of ions not electrons. A variety of solid electrolytes are inorganic crystals. Others are complexes of organic polymers and salts, such as complexes of poly (ethylene oxide) and alkali metal salts [see for example, Cowie et al, *Annu. Rev. Phys. Chem.,* Vol. 40, (1989) pp. 85–113, Shriver et al, *Chemical and Engineering News,* Vol. 63, (1985) pp. 42–57, Tonge et al, Chapter 5 *Polymers for Electronic Applications,* ed. Lai, CRC Press, Boca Raton, Fla., 1989, pp. 157–210, at 162, and Cowie, *Integration of Fundamental Polymer Science and Technology,* Vol. 2, Elsevoir Publisher, New York, 21.5 (1988), pp. 54–62].

Electrical surface conductivities for polymeric and inorganic solid ion conductors are in the range of about $1\times10^{-8}$ to 10 $(\text{ohms/square})^{-1}$ [Surface conductivity is equal to conductivity divided by thickness and is expressed as $(\text{ohms/square})^{-1}$]. Surface resistivity is equal to resistivity divided by thickness as expressed in ohms/square. For example, a resistivity of $1\times10^{14}$ ohms-cm for a layer having a thickness of 5 $\mu$m, equates to a surface resistivity of $2\times10^{17}$. Solid electrolytes are used in rechargeable lithium batteries, electrochemical sensors, and display devices.

It has been important that any silicon overcoats in electrophotographic charge generating elements be adequately adhered to underlying layers such as photoconductor charge generating layers. Workers in this field have attempted to provide that adhesion in a number of ways. For example, U.S. Pat. No. 4,413,088 (Frye) describes the use of organic solvents that etch the underlying layers. Thermoplastic acrylic polymers are described as primer materials in U.S. Pat. No. 4,239,798 and U.S. Pat. No. 4,210,699 (both Schroeter et al) to provide adhesion to polycarbonates. Other primer compositions are described in U.S. Pat. No. 4,197,335 (Goossens) to adhere organosiloxane coatings to polycarbonates.

Polymeric emulsions are preferred as primer compositions over the organic solvent-based compositions because the emulsions are composed primarily of water that will not damage polycarbonate surfaces. Additionally, the viscosity of the compositions is relatively low even with high molecular weight acrylate polymers. Yet U.S. Pat. No. 4,439,509 (Schank) and U.S. Pat. No. 4,595,602 (Schank) describe the use of organic solvents for coating acrylics and other polymers in primer layers.

U.S. Pat. No. 4,407,920 (Lee) teaches the use of a conductive primer in electrophotographic elements in order to maintain a low residual potential when the photoconductor is overcoated with a silicone resin. The low residual potential is desirable to produce images of high density and low background.

More recently, U.S. Pat. No. 5,693,442 (Weiss et al) and U.S. Pat. No. 5,731,117 (Ferrar et al) describe the use of silsesquioxanes in glassy solid electrolyte layers that are used as overcoats in electrophotographic charge generating elements. They also describe the use of primer layers between the charge generating layer and the solid electrolyte layer. Disclosed primer materials include vinyl polymers such as a poly(methacrylate-co-methylmethacrylate-co-methacrylic acid) latex and poly(vinyl pyrrolidone-co-methacrylic acid). In addition, U.S. Pat. No. 5,731,117 describes the primer layer composition as further including TRITON X-100 nonionic surfactant. This surfactant includes poly(ethylene oxide) moieties that are conductive in aqueous solutions.

Despite the advances provided by the inventions in the noted Ferrar et al and Weiss et al patents, there is a need to reduce the lateral image spread ("image width") even more, especially when the noted elements are used in electrophotography at high relative humidity.

SUMMARY OF THE INVENTION

The problems noted above have been overcome with an electrophotographic charge generating element comprising, in order:

a) an electrically conductive layer, b) a photoconductor charge generating layer, c) a primer layer having a surface resistivity of at least $10^{10}$ ohms/square, and comprising an addition polymer that is coatable from a water-miscible, polar organic solvent, the primer layer containing substantially no free ACTIVE groups, and d) a solid electrolyte layer comprising a silsesquioxane salt complex .

This invention also provides a developed electrophotographic element comprising the electrophotographic charge generating element described above and a deposited image of electrophotographic toner.

We have discovered that the specific primer layers used in this invention have the requisite conductivity for use with silsesquioxane overcoats so as to minimize lateral image. Thus, image discrimination is preserved with this invention even after multiple images are generated. This improvement is particularly noticeable when the element is used at high relative humidity. These properties are achieved because the primer layer is formulated with specific addition polymers and has substantially no free ACTIVE groups (such as ethyleneoxide, acrylic acid and other groups defined below). Thus, unlike the primer layers described in U.S. Pat. No. 5,731,117 (noted above), there are no surfactants like TRITON X-100 nonionic surfactant in the primer layers used in the present invention. The presence of such surfactants (and other compounds having ACTIVE groups) diminishes image discrimination.

In addition, the primer layer formulation is coated out of water-miscible organic solvents that will not damage the mechanical or electrical properties of the underlying photoconductor layer. The solid electrolyte layer containing the silsesquioxane serves as an overcoat and provides both good abrasion resistance and desired charge transport properties.

DETAILED DESCRIPTION OF THE INVENTION

Figure 1:
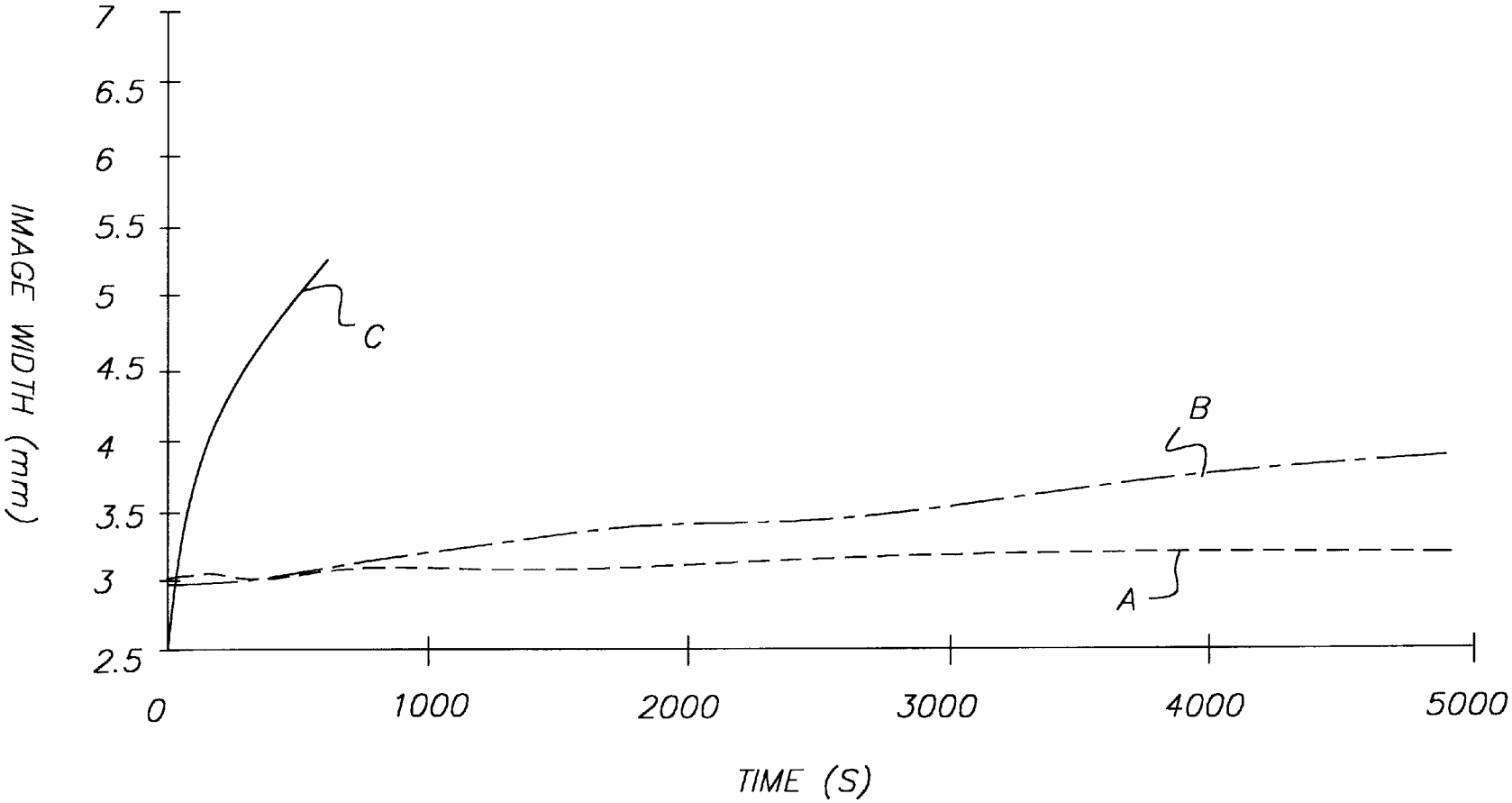
FIG. 1 is a graphical representation of image width evaluations with time for various electrophotographic elements as described in the Examples below.

The present invention is based upon the novel use of particular primer layers containing addition polymers beneath a silsesquioxane overcoat or solid electrolyte layer in electrophotographic charge generating elements. Because the silsesquioxanes are present in the form of complex salts, the overcoat also carries a charge, but the primer layer has limited conductivity.

The charge generating elements of the invention comprise an electrically conductive layer, a charge generating layer, a primer layer, and a solid electrolyte layer as a charge transporting layer. The elements can additionally comprise a separate support, but the support can also be the electrically conductive layer. The noted layers are preferably used in charge generating elements that are configured as electrophotographic elements. These elements are capable of charging positively or negatively and can take a wide variety of forms, as discussed in greater detail below.

In the charge generating elements of the invention, a charge generating layer overlies the electrically conductive layer. The solid electrolyte layer overlies the primer layer that overlies the charge generating layer. The resulting element is described herein as if the element is in the shape of a horizontally disposed flat plate. It is to be understood, however, that the element is not limited to any particular shape and that directional terms refer only to relative positions, not to an absolute orientation relative to the environment. The solid electrolyte layer, for convenience, is also referred to herein as the overcoat of the charge generating element. This terminology should not be understood as limiting the scope of the charge generating element, nor even necessarily implying that the overcoat is uppermost, although this is highly preferred.

Generally, the solid electrolyte layer has a thickness of at least 0.5 and preferably at least 1 $\mu$m, and generally up to 10 $\mu$m. The other layers of the element (besides the primer layer that is described below) can have a thickness that would be conventional in the art, as taught for example in the Weiss et al and Ferrar et al patents noted above, both of which are incorporated herein by reference for details of such conventional layers.

The solid electrolyte layer comprises a complex of a silsesquioxane and a charge carrier, both of which are defined in more detail below. The prefix "sesqui-" refers to a one and one-half stoichiometry of oxygen and the "siloxane" indicates a silicon containing material. Silsesquioxane can thus be represented by the general structure $(RSiO_{1.5})_z$ wherein R is an organic group and "z" represents the number of repeating units. This formula, which is sometimes written as $\{Si(O_{1/2})_3R\}_z$, is a useful shorthand for silsesquioxanes, but, except as to fully cured silsesquioxanes, it does not fully characterize the materials. This is important since silsesquioxanes can be utilized in an incompletely cured state. An additional nomenclature is described in U.S. Pat. No. 5,731,117 (noted above) and by Glaser et al, *J. Non-Crystalline Solids,* 113 (1989) 7387. This nomenclature uses the initials "M", "D", "T" and "Q" to designate silicon atoms in various silyl units bonded to 1, 2, 3 or 4 atoms, respectively.

As used herein "silsesquioxane" refers to both the conventional polymers described in the art as well as "modified silsesquioxanes" that are prepared by copolymerizing various siloxanes. Examples of conventional silsesquioxanes are illustrated with Structure II below, and examples of modified silsesquioxanes are illustrated in Structures I and IV below.

While the silsesquioxanes used in the present invention can exist and be used in various states of curing, they can be identified by their state of curing. The state of curing generally refers to the number of hydrolyzable groups that have been reacted in the polymer matrix. In preferred embodiments, partially cured polymers are used because of the thermal sensitivities of underlying layers. For example, in Structure I below, the silyl units present at "m" mole percent (or m' units) can have a state of curing identified as $T^0$, $T^1$, $T^2$ and $T^3$ as defined by the publication by Glaser et al. Fully cured silsesquioxanes are $T^3$. In partially cured polymers, substantially all silyl units are $T^2$ or $T^3$. Thus, the extent of curing can be quantified as the ratio of $T^2$ to $T^3$, which ratio decreases with increased curing.

In addition, the silyl units present at "n" mole percent in Structures I and IV can be designated as $D^1$ or $D^2$, depending upon their state of curing, as described by Glaser et al. Similarly, the ratio of $D^1$ to $D^2$ is indicative of the state of curing and decreases with an increase in curing. "D" silyl units may be present in the solid electrolyte layer if not covalently bound to the silsesquioxane.

In general, the molar ratio of carbon atoms to silicon atoms in the silsesquioxane polymers used in the practice of this invention is at least 1.1:1. Preferably, the molar ratio is at least 1.2:1.

The silsesquioxanes useful in the present invention can be generally represented by the following Structure I:

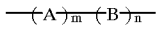

wherein —A— is represented by Structure Ia:

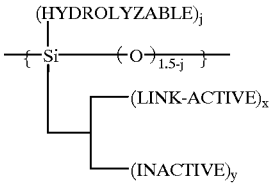

and —B— is represented by Structure Ib:

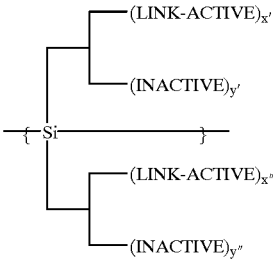

In addition, the electrolytic compositions of this invention can comprise a mixture of homopolymers or copolymers that are represented by Structures II and III:

II

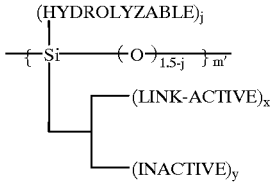

III

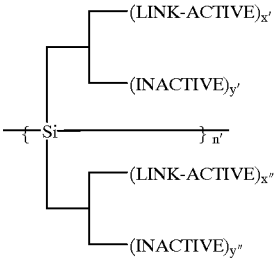

The components of all of these Structures are defined in more detail below.

Particularly useful silsequioxanes can be illustrated by the following structure IV showing two types of copolymerized silyl units:

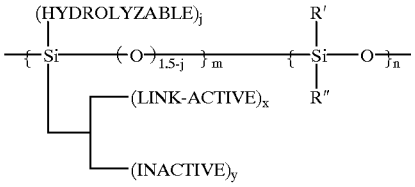

In the Structures noted above, "HYDROLYZABLE" represents hydroxy or a "hydrolyzable group" that is monovalent and that readily hydrolyzes under the conditions employed during preparation of the polymer. The HYDROLYZABLE groups in the polymer represent the individual groups that were not hydrolyzed during preparation because of steric constraints or other reasons. Generally, in the polymer useful in this invention, most of the HYDROLYZABLE groups are hydroxy groups. However, other HYDROLYZABLE groups can be present, including but not limited to, hydrogen, halo groups (such as iodide, bromide and chloride), alkoxy groups having from 1 to 6 carbons, aryloxy groups wherein the aryl portion can be substituted or unsubstituted (for example aminophenyl), substituted or unsubstituted alkylcarboxy groups wherein the alkyl portion has 1 to 6 carbon atoms (such as acetoxy and ethylcarboxy), and -(O-alkylene)p—O- alkyl groups wherein the "alkylene" portion is a substituted or unsubstituted alkylene group having from 2 to 6 carbons, p is an integer from 1 to 3, and the "alkyl" portion is a substituted or unsubstituted alkyl group having from 1 to 6 carbons. Other useful HYDROLYZABLE groups include primary and secondary amino groups having from 1 to 6 carbon atoms, such as $-N(alkyl)_2$ wherein each alkyl group can independently have from 1 to 6 carbon atoms and -NH(alkyl) wherein the alkyl group can have from 1 to 6 carbon atoms, and alkylcarboxyalkyl groups wherein the "alkyl" portion has from 1 to 6 carbon atoms (such as acetoxymethyl and acetoxyethyl). It is preferred that substantially all HYDROLYZABLE groups be hydroxy groups.

A small percentage of silicon atoms in the silyl groups could bear two or three "non-hydrolyzable" organic groups, or a small percentage of silicon atoms could be replaced by atoms of another metal, such as aluminum, or a small percentage of silicon atoms in those silyl groups could bear organic groups not within the scope of the definitions of LINK-ACTIVE and INACTIVE as defined herein.

The silsesquioxanes useful in this invention are relatively large oligomers or polymers. The total number of silyl units represented by both "m" and "n" in Structures I and IV (that is, the total number of silyl units) in each polymer should be at least 10. As the number of silyl units is increased, the silsesquioxane becomes, in effect, a very large single molecule. Like highly crosslinked polymers, there is theoretically no upper limit on the number of silyl units and the total number of silyl units can be a very large number. Preferably, the silsesquioxane polymers have at least 25 total silyl units distributed in the molar ratio defined by m and n. Similarly, each of m' and n' is at least 10, and preferably each is at least 20, provided that the relative weight percents of the silsesquioxane and polymer of Structures II and III are adjusted in the mixture as described below.

In Structure IV, R' and R" are independently substituted or unsubstituted alkyl groups having 1 to 10 carbon atoms (such as methyl, ethyl, propyl, isopropyl, t-butyl, chloromethyl, hexyl, benzyl and octyl), or a substituted or unsubstituted aryl group having from 6 to 10 carbon atoms in the carbocyclic ring (such as phenyl, m- or p-ethylphenyl, m- or p- methylphenyl and naphthyl). Thus, the R' and R" groups can be the same or different group. However, preferably, each of R' and R" is methyl, ethyl or phenyl. Most preferably, each is methyl.

Because both R' and R" are non-hydrolyzable groups (as "hydrolyzable" is defined above), the silyl units containing R' and R" are derived from silanes that have only two HYDROLYZABLE groups. One or more of such silanes can be used to prepare the silsesquioxanes useful in the practice of this invention.

In Structures I and IV, m can be from about 50 to 100 mole percent, preferably from about 50 to about 99 mole percent, and more preferably from about 75 to about 99 mole percent, based on the total silyl (—OSi—) units in the silsesquioxane. Correspondingly, n is from 0 to about 50 mole percent, preferably from about 1 to about 50 mole percent, and more preferably from about 1 to about 25 mole percent, based on the total silyl units. A skilled artisan would readily be able to use the appropriate amounts of the various types of silanes to obtain the desired molar ratios in the resulting silsesquioxane polymers to provide the desired properties. The most preferred silsesquioxanes are those wherein n is at least 1 mole percent, and preferably at least 10 mole percent (generally up to 50 mole percent and preferably up to 25 mole percent). The preparation and use such silsesquioxanes are described in copending and commonly assigned U.S. application Ser. No. 09/223,429 filed on even date herewith by Ferrar, Yoerger, Cowdery, Sinicropi, Parton and Weiss, and entitled "Silsesquioxane Electrolytic Composition and Electrophotographic Charge Generating Element Containing Same".

The value of j in Structures I, II, and IV is less than or equal to 0.5 and greater than or equal to 0. Preferably, j is greater than or equal to 0 and less than or equal to 0.4. More preferably, it is from about 0.1 to about 0.4. The value of j corresponds to the mole percentage of $T^2$ silicon atoms relative to the total of $T^2+T^3$ silicon atoms. When j is from 0 to 0.5, it reflects a $T^3/T^2$ of from about 1:1 to about 0:1. A preferred ratio is from about 0.7:1 to about 0:1.

Also in the noted Structures, x+y, x'+y' and x"+y" are independently equal to about 1. The values of x and y (and similarly, x' and y' and x" and y"), that is, the relative molar concentrations of "active" units (silyl-units bearing a -LINK-ACTIVE group) and "inactive" units (silyl units bearing an -INACTIVE group), can be varied to provide desired resistivity. In preferred embodiments of the invention, active units represent less than about 45 mole percent of the silyl units of the polymer. In other words, (x+x'+x")/(x+y+x'+y'+x"+y") is less than or equal to 0.45. In Structure IV, x/(x+y) is less than or equal to 0.45.

INACTIVE represents an aromatic or nonaromatic group having from 1 to 12 carbon atoms. INACTIVE groups are not capable of participation in a siloxane polycondensation reaction and do not transport charge. The following monovalent or divalent groups are examples of suitable INACTIVE groups: substituted or unsubstituted alkyl groups having from 1 to 12 carbons (including linear and branched alkyl groups, including benzyl groups), substituted or unsubstituted fluoroalkyl groups having from 1 to 12 carbons (including branched or linear alkyl groups), substituted or unsubstituted cycloalkyl groups having a single 5- or 6-membered carbocyclic ring (such as substituted and unsubstituted cyclopentyl and cyclohexyl groups), and substituted or unsubstituted aryl groups having a 6- to 10-membered carbocyclic ring (such as substituted or unsubstituted phenyl and naphthyl groups). Monovalent groups are bonded to the Si atom of a single silyl unit of the silsesquioxane. Divalent groups are bonded to the Si atoms of two silyl units. INACTIVE groups can all be the same or different throughout the polymer. Specific examples of monovalent INACTIVE groups include but are not limited to, methyl, ethyl, n-propyl, isopropyl, n-butyl, isobutyl, t-butyl, n-decyl, perfluorooctyl, cyclohexyl, phenyl, dimethylphenyl, benzyl, naphthyl and trimethylsiloxy groups. A representative divalent INACTIVE group is a 1,4- or 1,3- phenylene group that links two silyl units of the silsesquioxane.

LINK represents divalent groups corresponding to the monovalent groups described above for defining INACTIVE. For example, LINK can be a substituted or unsubstituted alkylene group having from 1 to 12 carbon atoms that can have arylene groups in the chain (such as methylene, ethylene, isopropylene or methylenephenylene), a substituted or unsubstituted fluoroalkylene group having from 1 to 12 carbon atoms (such as fluoromethylene and other groups similar to those used in the definition of alkylene), a substituted or unsubstituted cycloalkylene group having 5 to 10 carbon atoms in the ring (such as cyclohexylene), or a substituted or unsubstituted arylene group having 6 to 10 carbon atoms in the carbocyclic ring (such as phenylene) as described above.

ACTIVE is a group in the silsesquioxane polymer that is complexed with the charge carrier in the solid electrolyte layer. In preferred embodiments of the invention, ACTIVE is a monovalent organic group having from 4 to 20 carbon, nitrogen, oxygen or sulfur atoms in any suitable form (linear, branched, carbocylic or heterocyclic). Many ACTIVE groups contain at least one oxy, thio, ester, imino or amino groups. Suitable ACTIVE groups that complex with cations include neutral rings and chains of ethylene oxides, propylene oxides and tetramethylene oxides, ethylene imines, alkylene sulfides, glycidoxy ethers, epoxides, pyrolidinones, amino alcohols, amines, carboxylic acids and the conjugate salts, sulfonic acids and the conjugate salts, ammonium salts, phosphonium salts, sulfonium salts, and arsonium salts.

In at least some embodiments of the invention, the ACTIVE group is capable of participation in a siloxane polycondensation reaction as a catalyst. Examples of such groups are primary, secondary, tertiary and quaternary amines. The concentration of such catalytic active silyl units can be varied to provide a convenient reaction rate. In some preferred embodiments of the invention, from about 0.5 to about 30 mole percent of the silyl units in the polymer include any of the following active groups:

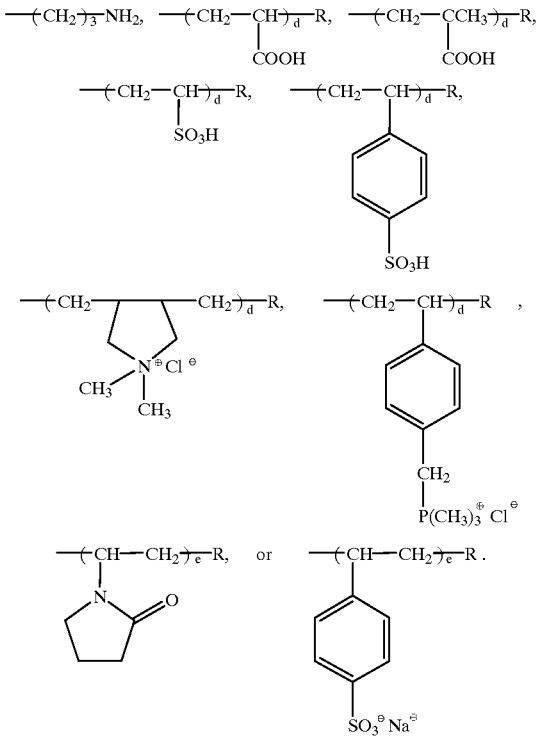

In the above groups, d and e are selected such that the total number of carbons in -LINK-ACTIVE is from 4 to 25.

The following groups are also specific examples of -ACTIVE groups:

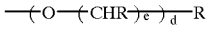

wherein e is from 2 to 5, and d is from 1 to 6,

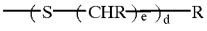

wherein e is from 2 to 5, and d is from 1 to 6,

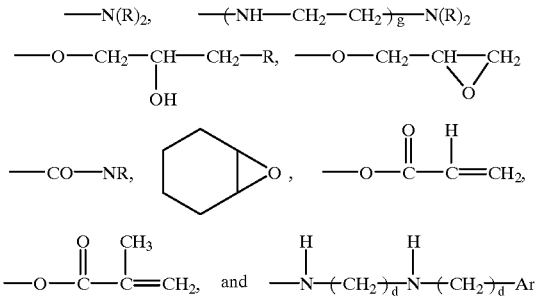

wherein d is from 1 to 6.

In these groups, unless otherwise indicated, R is hydrogen, a substituted or unsubstituted alkyl group, or a substituted or unsubstituted fluoroalkyl group, each having from 1 to 12 carbons (as defined above for other alkyl and fluoroalkyl groups), g is from 1 to 12, Ar is a substituted or unsubstituted aryl group having a single 6- to 10-membered carbocyclic ring (as described above for other aryl groups). The total number of carbons in -LINK-ACTIVE is from 4 to 25. Specific examples of some -LINK-ACTIVE groups include but are not limited to aminopropyl, dimethylaminopentyl, propylethylene diamine, propylethylene triamine, 3-glycidoxypropyl, 2-(3,4-epoxycyclohexyl) ethyl, 3-acryloxypropyl, 3-methacryloxypropyl, 3-isocyanatopropyl and N-[2-(vinylbenzylamino)ethyl]-3-aminopropyl. It is possible that the substituents of the ACTIVE groups may react with one another to further increase crosslinking in the polymer, such as by ring opening of an epoxide by an amine.

Some considerations apply to both the "active" and "inactive" silyl units of the silsesquioxane. The polymer can include a mixture of different "active" silyl units or a mixture of different "inactive" silyl units or mixtures of both. The -LINK-ACTIVE and INACTIVE groups should not be substantially hydrolyzed in the siloxane polycondensation reaction used to prepare the silsesquioxane polymer since the organic substituents would be lost and the resulting polymer would exhibit a very high degree of crosslinking. Moreover, the -LINK-ACTIVE and INACTIVE groups should not be so large as to cause steric problems. For example, a suitable maximum for the number of carbon and heteroatoms in a -LINK-ACTIVE group is 25 and for an INACTIVE group it is 12.

The charge carrier used in the solid electrolyte layer is selected based upon the selection of the ACTIVE groups in the silsesquioxane. The term "charge carrier" is used herein to describe a substance that complexes with the ACTIVE group to yield a mobile species or combination of species that carry charge within the solid electrolyte layer. The charge carrier can be a salt or mixture of salts. The mobile species is one or both ions of the salt or one or both ions of the various salts of the mixture. The charge carrier can also be or include a substance that, as an isolated material, is not a salt. An example of the latter type of charge carrier is the complexation product of molecular iodine. This type of charge carrier provides a mobile species that forms a donor-acceptor or charge-transfer complex with the ACTIVE group in which the resulting charge separation has substantial ionic character.

A wide variety of charge carriers can be used in the practice of this invention. Selection of a suitable charge carrier for a particular use is a matter of relatively simple trial and error. The charge carrier must be capable of forming a complex with the ACTIVE group such that the silsesquioxane-charge carrier complex is electrically conducting. In preferred embodiments of the invention, the charge carrier must be capable of forming a complex with the ACTIVE group such that the silsesquioxane-charge carrier complex is electrically conducting in the absence of moisture. For salts, this is commonly described as "dissolving in the matrix". An explanation of this "dissolving" is described in U.S. Pat. No. 5,731,117 (noted above).

Complex formation with a particular ACTIVE group can be determined by a variety of means. For example, Fish et al [*Makromol. Chem. Rapid Commun.* Vol. 7, (1986), pp. 115–120] teach that complex formation can be tracked by measuring the increase in glass transition temperature (Tg) as the amount of salt or other charge carrier in the polymer is increased. Care must be taken to account for changes in Tg due to curing during the analysis.

The charge carrier and ACTIVE group are selected to provide a particular electrical conductivity, and its inverse, resistivity, under conditions of low ambient relative humidity (except in embodiments where water provides the charge carrier). Particular ranges are desirable for solid electrolytes used for a number of different purposes. For example, a solid electrolyte layer used in an electrophotographic element has a desirable surface resistivity of at least $1\times10^{10}$ ohms/sq, or more desirably, a surface resistivity of at least $1\times10^{14}$ ohms/sq.

The charge carrier and ACTIVE group can also be selected so as to provide other characteristics desired in a particular embodiment of the invention. For example, the charge carrier used in a solid electrolyte layer of an electrophotographic element can be selected to provide particular tribocharging characteristics, both in terms of polarity and placement in a triboelectric series relative to toner and carrier materials.

For another example, the charge carrier and ACTIVE group can be selected such that "blooming" is eliminated or reduced. Ammonium salts can be used as charge carriers. However, these salts "bloom", that is, migrate to the surface of a solid electrolyte layer resulting in an enhanced degree of ammonium activity on the surface or in an upper layer. Ammonium salts are commonly used to cure silsesquioxanes. Blooming is a recognized shortcoming of that procedure. In electrophotography, blooming is undesirable since it may cause variability in electrophotographic properties, leading to problems such as image artifacts. A charge carrier can be selected that is non-blooming or resistant to migration. The "curing" or catalytic function that would otherwise be provided by the ammonium salts can be provided by selection of an ACTIVE group that is a siloxane polycondensation catalyst. The ACTIVE group is not mobile within the solid electrolyte layer and thus does not bloom.

The charge carrier can be an inorganic or organic alkali salt, one or both ions being mobile in the complex. Such suitable salts include, but are not limited to LiCl, $CH_3COOLi$, $LiNO_3$, $LiNO_2$, LiBr, $LiN_3$, $LiBH_4$, LiI, LiSCN, $LiCl\mathbf{0}_4$, $LiCF_3SO_3$, $LiBF_4$, LiBPh4, NaBr, $NaN_3$, $NaBH_4$, NaI, NaSCN, $NaClO_4$, $NaCF_3SO_3$, $NaBF_4$, $NaBPh_4$, KSCN, $KCIO_4$, $KCF_3SO_3$, $KBF_4$, $KBPh_4$, RbSCN, $RbClO_4$, $RbCF_3SO_3$, $RbBF_4$, $RbBPh_4$, CsSCN, $CsClO_4$, $CsCF_3SO_3$, $CsBF_4$, $CsBPh_4$. "Ph" used herein represents a phenyl group (substituted or unsubstituted). These salts are highly resistant to blooming when used with the silsesquioxanes useful in the practice of this invention. Other suitable salts include quaternary ammonium salts, ammonium hydroxide and ammonium halides. These salts and the other salts previously listed can be used individually or in combination.

A suitable concentration of charge carrier in a silsesquioxane electrolytic coating composition or the resulting solid layer is from about 0.1 to 10 weight percent relative to the dry weight of the silsesquioxane. A currently preferred charge carrier is LiI, and a currently preferred concentration is from about 0.5 to 2 weight percent relative to the dry weight of the silsesquioxane.

In some embodiments of this invention, the silsesquioxane polymers can also have silyl units represented by the structures described in Columns 12–14 of U.S. Pat. No. 5,731,117 (noted above) as long as those silyl units are included among the silyl units present at "m" mole percent in Structures I and IV, and represented by Structure II. Further details of the structures in Cols. 12–14 will not be included here, but are incorporated herein by reference.

The solid electrolyte layer used in the invention can include a wide variety of addenda such as fillers including metal oxide particles and beads of organic polymers. Fillers can be added to modify some of the properties of the resulting solid electrolyte layer. For example, metal oxide particles could be added to increase abrasion resistance, and fluorocarbon polymer beads could be added to reduce frictional loads on the surface. Filler is added in a concentration that is small enough to not cause deleterious changes in the physical properties of the solid electrolyte layer. Some fillers can be covalently bonded into the overall matrix of the silsesquioxane. An example of such a filler material is colloidal hydrophilic silica, such as basic LUDOX silica available from DuPont. The solid electrolyte layer may also include one or more surfactants such as fluorosurfactants that provide surface lubricity and protection.

In some embodiments of the invention, the solid electrolyte layer can include what is referred to herein as a "secondary active agent". The secondary active agent is a non-silsesquioxane compound that includes one or more ACTIVE groups, as those groups are defined above for the silsesquioxane polymer. In a particular solid electrolyte layer, the ACTIVE groups of the secondary active agent can be the same or different than those of the silsesquioxane polymer. A single secondary active agent or a number of different secondary active agents can be present in the solid electrolyte layer. The secondary active agent may or may not be involved in charge transport. If the secondary active agent is involved, the additional charge transport provided increases conductivity less than about 5 or 10%. The secondary active agent can provide additional functions such as a plasticizing or lubricating function.

In addition, the solid electrolyte layer can include an alcohol-soluble surfactant. Suitable classes of surfactants include siloxane-alkylene oxide copolymers available from Dow Corning and OSi Specialties (formerly Union Carbide). These materials act as plasticizers and lubricants and are also secondary active agents. Also useful are cationic surfactants such as FC135 fluorosurfactant (available from 3M Corp.) that contains a tetraalkylammonium iodide as the cationic group. This material can also be a charge carrier with iodide ions as the mobile species, and includes tetraalkylammonium ACTIVE groups. Also useful are anionic surfactants, such as those sold under the trademarks TRITON, AEROSOL and ALIPAL. These surfactants contain sodium salt groups which can act as charge carriers, that is, the sodium salt groups can ionize in the solid electrolyte to provide low lattice energy salts as mobile species. Also useful is the ZONYL FSN surfactant from DuPont that contains ethylene oxide ACTIVE groups and iodide salts.

In another embodiment of the invention, the surfactant is a poly(alkylene oxide)-co-poly(dimethylsiloxane) as described in U.S. Pat. No. 5,731,117 (noted above). A specific example of such surfactants is commercially available as SILWET Surface Active Copolymers from OSi Specialties, Inc. (such as SILWET L-7002 surfactant).

In some embodiments of the invention, the solid electrolyte layer can include a plasticizer that is incorporated into the silsesquioxane polymer matrix. Examples of classes of suitable plasticizers include alkyltris(polysiloxane polyether copolymers)silanes, that are similar in structure to the surfactants noted above, but are bulkier and tend to stay in the silsesquioxane polymer matrix to a greater degree. Examples of suitable alkyltris(polysiloxane polyether copolymers)silanes are the polysiloxane polyether copolymers described in U.S. Pat. No. 4,227,287 (Frye). Such materials are available commercially from OSi Specialties under the designation L-540 and from Dow Corning Corporation under the designation DC-190. Suitable concentrations are from about 0.5 to 6 parts by weight based on the dry weight of the silsesquioxane. Another useful plasticizer or lubricant is trimethylsiloxyl terminated poly (dimethylsiloxane) having a molecular weight of less than about 5,000 and preferably having a molecular weight from about 300 to about 3000.

Other plasticizers that would remain free to migrate within the silsesquioxane polymer are not preferred, but can be added in amounts small enough to not unacceptably degrade the physical and electrical properties of the resulting element. Such plasticizers include nylons such as ELVAMIDE 9061 and ELVAMIDE 8064 (available from DuPont).

In the elements of this invention, the solid electrolyte layer can include a Lewis base that acts as an acid scavenger. As a practical matter, the acid scavenger should be soluble in the solvent(s) or solvent medium used to prepare the silsesquioxane. Examples of suitable materials include, but are not limited to amines including substituted or unsubstituted arylamines.

The solid electrolyte layer used in this invention is prepared in a manner similar to the preparation of a silsesquioxane noted in U.S. Pat. No. 5,731,117 (noted above). The polymers can be formed at moderate temperatures by a type of procedure commonly referred to as a "sol-gel" process. In this process, the appropriate silicon alkoxides (or other polymerizable compounds to provide the desired silyl units) are hydrolyzed in an appropriate solvent medium, forming the "sol". Then the solvent medium is removed resulting in a condensation and the formation of a crosslinked gel. A variety of solvents can be used. Water, lower alcohols (such as methanol, ethanol, and isopropanol) and mixtures thereof (such as aqueous methanolic or ethanolic solutions) are generally preferred. Aqueous-alcohol solvent mixtures are most preferred as the solvent medium. The silsesquioxanes are conveniently coated from acidic alcohols, since the silicic acid form $RSi(OH)_3$ can be stable in solution for months at ambient conditions. The charge carrier is then added in an appropriate concentration along with any addenda prior to the polycondensation reaction. The extent of condensation is related to the amount of curing a polymer sample receives, with temperature and time being among the two most important variables.

In the preparation of the solid electrolyte layer used in the invention, the reactive silicon precursor compounds (silanes) that include -LINK-ACTIVE and INACTIVE groups in the proportions desired in the resulting silsesquioxanes include, but are not limited to: methyltrimethoxysilane, methyltriethoxysilane, n-propyltrimethoxysilane, n-propyltriethoxysilane, (3,3,3-trifluoropropyl)trimethoxysilane, methyltriacetoxysilane, 3-aminopropyltrimethoxysilane, 3-aminopropyltriethoxysilane, 3-aminopropylmethyldiethoxysilane, 3-aminopropyldimethylethoxysilane, 3-aminopropyldiisopropylethoxysilane, 3-aminopropyltris-(methoxyethoxyethoxy)silane, 3-(1-aminopropoxy)-3,3-dimethyl- 1-propenyltrimethoxysilane, N-(6-aminohexyl) aminopropyltrimethoxysilane, N-2-(aminoethyl)-3-aminopropyltris(2-ethylhexoxy)silane, N-(2-aminoethyl)-3-aminopropyltrimethoxysilane, N-(2-aminoethyl)-3-aminopropylmethyl-dimethoxysilane, (aminoethylaninomethyl)-phenethyltrimethoxysilane, 4-aminobutyltriethoxysilane, (N,N-dimethyl-3-aminopropyl)trimethoxysilane, N-methylaminopropyltrimethoxysilane, N-[(3-trimethoxysilyl)propyl]-ethylenediamine triacetic acid trisodium salt, N-trimethoxysilylpropyl-N,N,N-trimethylammonium chloride, N-trimethoxysilylpropyltri-N-butylammonium bromide, 2-(3,4-epoxycyclohexyl)cthyltrimethoxysilane, 3-isocyanatopropyltriethoxysilane, 3-isocyanatopropyldimethylchlorosilane, 5,6-epoxyhexyltriethoxysilane, (3-glycidoxypropyl) trimethoxysilane, (3-glycidoxypropyl)methyldiethoxysilane and (3-glycidoxypropyl)methyl-dimethoxysilane.

Silane reactants having only two HYDROLYZABLE groups as defined above include but are not limited to, dimethyldimethoxysilane, diethyldimethoxysilane, diisopropyldimethoxysilane, diphenyldimethoxysilane, dimethyldiethoxysilane, diethyldiethoxysilane, diphenyldiethoxysilane and 1,7-dichlorooctamethyltetrasiloxane. Dimethyldimethoxysilane is a most preferred silane reactant of this type.

Another essential layer of the elements of this invention is a primer or adhesive layer between the charge generating layer and the solid electrolyte layers. The primer layer is selected so as to provide a good mechanical bond between the two layers, but not to interfere with charge related properties. The dry thickness of the primer layer is generally from about 0.1 to about 1.0 $\mu$m and is preferably up to 0.5 $\mu$m. It is important that neither the primer, nor the solvent that the primer is coated from, damage the photoconductor layers.

In addition, the primer layer should have a surface resistivity of at least $10^{10}$ ohms/square, and preferably of at least $10^{14}$ ohms/square.

Suitable coating solvents include water, lower alcohols (methanol, ethanol and isopropanol), and other water-miscible, polar organic solvents (such as ethyl acetate, acetone and 2-propanone), and mixtures thereof. The aqueous alcoholic solvent mixtures are preferred, and an aqueous methanolic mixture or an alcohol/ethyl acetate mixture is most preferred.

Suitable primers include one or more addition polymers that are either soluble or form emulsions in these solvents. In addition, the primer polymer (or mixtures thereof) should have a glass transition temperature of at least 25° C., and preferably of from about 30 to about 170° C. Glass transition temperature for polymers is a conventional parameter that can be measured using known procedures and instrumentation. By "addition" polymer is meant a homopolymer or copolymer prepared by polymerizing one or more olefinically unsaturated polymerizable monomers using any suitable polymerization technique. Thus, "addition" polymer does not mean that the polymer must be prepared only by what are known in the art as "addition polymerization" techniques.

Examples of suitable primer polymers include, but are not limited to, acrylics, pyrrolidones and styrenics. The acrylics are most preferred. The polymers are generally prepared by polymerizing one or more olefinically unsaturated polymerizable monomers in an appropriate reaction medium using conventional procedures, conditions and catalysts. For example, some of the useful monomers include but are not limited to, methyl acrylate, ethyl acrylate, methyl methacrylate, ethyl methacrylate, hydroxymethyl acrylate, acrylic acid, methacrylic acid, itaconic acid, styrene, vinyl toluene, acrylonitrile, isobutyl methacrylate, and so many others that would be readily apparent to one skilled in the art. The methyl and ethyl acrylates and methacrylates are preferred.

The useful primer polymers can be homopolymers prepared from individual monomers. Preferably, however, they are copolymers prepared from two or more of such monomers in proportions that provide the desired characteristics noted above (coatability from coating solvents, glass transition temperature and conductivity of coated layer). For example, copolymers prepared from methyl acrylate and methyl methacrylate are desirable. A skilled artisan could carry out routine experimentation to determine the various copolymers and monomer ratios that would be useful in the practice of the present invention.

Some particularly useful primer polymers are various poly(methyl acryl-ate-co-methyl methacrylate-co-methacrylic acid)s in various monomer weight ratios. The most preferred weight ratio of the three polymerizable monomers is 70/25/5 weight ratio. The synthesis of this particular polymer is described in U.S. Pat. No. 5,731,117 (noted above), but other vinyl polymers could be similarly prepared. Another example of a specific primer polymer is poly(vinyl pyrrolidone-methacrylic acid) (95/5 weight ratio).

In addition, the primer layer is composed of a composition comprising one or more addition polymers as described above [particularly poly(methyl acrylate-co-methyl methacrylate-co-methacrylic acid) as described above], and contains substantially no "free" compounds (including nonionic surfactants) that include ACTIVE groups as defined herein. By "free" we mean that while the primer layer may include ACTIVE groups that are covalently attached to the primer polymer(s) in some manner, the primer layer contains substantially no other compounds in admixture with the primer polymers that would include such ACTIVE groups in either ionic or covalent form. By "substantially no" is meant that the primer layer contains free compounds having ACTIVE groups at a concentration that is less than 0.1 weight % based on dry layer weight. When ACTIVE groups are bound to the primer polymer(s), they can be present in an amount of up to 10 weight % based on the dry polymer(s) weight.

Specifically, the primer layers used in this invention do not include any compounds such as surfactants that include oxyalkylene groups as would be in the case in certain TRITON nonionic surfactants (such as ethyleneoxy groups in TRITON X-100 nonionic surfactant) or acrylic acid groups. Such compounds are present at greater than 0.1 weight % in the primer layers of U.S. Pat. No. 5,731,117 (noted above) and as such are detrimental to image discrimination.

All of the electrophotographic elements of the invention have multiple layers, since each element has at least an electrically conductive layer and one photoconductive (charge generating) layer, that is a layer that includes a charge generation material, in addition to a primer layer and a solid electrolyte overcoat layer.

The electrophotographic elements of the invention can be of various types including both those commonly referred to as single layer or single-active-layer elements and those commonly referred to as multiactive, or multiple-active-layer elements.

Single-active-layer elements are so named because they contain only one layer, referred to as the photoconductor or photoconductor charge generating layer, that is active both to generate and to transport charges in response to exposure to actinic radiation. Such elements have an additional electrically conductive layer in electrical contact with the photoconductor charge generating layer. In single-active-layer elements of the invention, the photoconductor charge generating layer contains charge-generation material to generate electron/hole pairs in response to actinic radiation and a charge-transport material, that is capable of accepting electrons or holes generated by the charge-generation material and transporting them through the layer to effect discharge of the initially uniform electrostatic potential. The charge-transport agent and charge generation material are dispersed as uniformly as possible in the photoconductor charge generating layer. This layer also contains an electrically insulative polymeric film-forming binder. The layer is electrically insulative except when exposed to actinic radiation.

Multiple-active-layer elements are so named because they contain at least two active layers, at least one of which is capable of generating charge, that is, electron/hole pairs, in response to exposure to actinic radiation and is therefore referred to as a charge-generation layer (CGL), and at least one of which is capable of accepting and transporting charges generated by the charge-generation layer and is therefore referred to as a charge-transport layer (CTL). In the invention, multiple-active-layer elements have an electrically conductive layer, a CGL, a CTL, and a solid electrolyte layer. Either the CGL or the CTL is in electrical contact with both the electrically conductive layer and the remaining CTL or CGL. The CGL contains charge-generation material and a polymeric binder. The CTL contains a charge-transport agent and a polymeric binder.

Single-active-layer and multiple-active-layer electrophotographic elements and their preparation and use in general, are well known and are described in more detail, for example, in U.S. Pat. No. 4,701,396, U.S. Pat. No. 4,666,802, U.S. Pat. No. 4,578,334, U.S. Pat. No. 4,719,163, U.S. Pat. No. 4,175,960, U.S. Pat. No. 4,514,481 and U.S. Pat. No. 3,615,414, the disclosures of which are incorporated herein by reference.

In preparing the electrophotographic elements of the invention, the components of the photoconductor charge generating layer, including binder and any desired addenda, are dissolved or dispersed together in a liquid to form an electrophotographic coating composition which is then coated over an appropriate underlayer, for example, a support or electrically conductive layer. The liquid is then allowed or caused to evaporate from the mixture to form the permanent photoconductive layer or CGL.

The polymeric binders used in the preparation of the coating compositions can be any of the many different binders that are useful in the preparation of electrophotographic layers, and are described in considerable detail in U.S. Pat. No. 5,731,117 (noted above). The polymeric binder is a film-forming polymer having a fairly high dielectric strength. In preferred embodiments of the invention, the polymeric binders also have good electrically insulating properties.

Suitable organic solvents for forming the polymeric binder solution can be selected from a wide variety of organic solvents, and are also described in U.S. Pat. No. 5,731,117 (noted above).

In the coating compositions for the CGL or photoconductor layer, the optimum ratios of charge generation material or of both charge generation material and charge transport agent, to binder can vary widely, depending on the particular materials employed. In general, useful results are obtained when the total concentration of both charge generation material and charge transport material in a layer is within the range of from about 20 to about 90 weight percent, based on the dry weight of the layer. In a preferred embodiment of a single active layer electrophotographic element of the invention, the coating composition contains from about 10 to about 70 weight percent of a charge-generation material and from 10 to about 90 weight percent of charge transport material.

Polymeric binders, charge transport materials and concentrations useful for the CGL or photoconductor layer are also useful for a CTL. The CTL can be solvent coated in the same manner as the charge generating layer. The coating composition can use the same solvents as in the charge generating layer. A similar process of preparing and then coating an appropriate coating composition can be followed for charge transport layers.

Any charge generation and transport materials can be utilized in elements of the invention. Such materials include inorganic and organic (including monomeric organic, metallo-organic and polymeric organic) materials; for example, zinc oxide, lead oxide, selenium, phthalocyanine, perylene, arylamine, polyarylalkane, and polycarbazole materials, among many others.

Various electrically conductive layers or supports can be employed in electrophotographic elements of the invention, for example, paper (at a relative humidity above 20%) aluminum-paper laminates, metal foils (such as aluminum foil and zinc foil), metal plates (such as aluminum, copper, zinc, brass and galvanized plates), vapor deposited metal layers (such as silver, chromium, vanadium, gold, nickel and aluminum), and semiconductive layers (such as cuprous iodide and indium tin oxide). The metal or semiconductive layers can be coated on paper or conventional photographic film bases such as poly(ethylene terephthalate), cellulose acetate, polystyrene, etc. Such conducting materials as chromium, nickel can be vacuum-deposited on transparent film supports in sufficiently thin layers to allow electrophotographic elements so prepared to be exposed from either side.

Electrophotographic elements of the invention can include various additional layers known to be useful in electrophotographic elements in general, for example, subbing layers, barrier layers (for example, charge blocking layers) and screening layers.

The electrophotographic charge generating elements of this invention can be imaged using an appropriate imaging source to generate a charged image pattern on the surface thereof. Appropriately charged toner developer can then be applied to provide a developed or deposited toned image on the element. The methods and materials for imaging and developing the elements would be readily apparent to a skilled artisan from the considerable literature relating to this field of technology.

The following synthetic methods are provided as illustrating methods of preparing silsesquioxane polymers and vinyl primer polymers useful in the elements of this invention.

Preparation of Silsesquioxane Polymer A:

All chemicals were purchased from Aldrich Chemical Company, except for DMS-E12 Epoxypropoxypropyl Terminated PolyDimethylsiloxane (molecular weight 900–1100) that was purchased from Gelest (Tullytown, Pa.). The acid scavenger bis[N-ethyl-N-(2-hydroxyethyl)aniline] diphenylmethane was prepared in the laboratory using conventional procedures.

A 1-liter sol-gel formulation was prepared in a two liter round bottom flask as follows:

Glacial acetic acid (54.0 grams, 0.9 mol) was added dropwise to a previously prepared, stirred mixture of DMS-E12 (2.0 g), methyltrimethoxysilane (275.4 g, 2.02 mol), 3-glycidoxypropyltrimethoxysilane (30.6 grams, 0.130 mol), and 3-aminopropyltrimethoxysilane (25.0 grams, 0.139 mol) and the reaction mixture was stirred overnight. The acidified silanes were then hydrolyzed by the dropwise addition of water (156 grams, 8.67 mol) and the reaction mixture was stirred overnight. It was then diluted to approximately 20 weight % solids by the dropwise addition of ethanol (523 grams). The clear solution was stirred for 3 weeks. The acid scavenger (4.0 g, 8.1 mmol) and lithium iodide (1.5 g, 11.2 mmol) were added and the solution filtered through a 0.4 $\mu$m glass filter and stored at 4° C.

Preparation of Silsesquioxane Polymer B:

The synthesis of a preferred silsesquioxane was carried out similarly to the synthesis described above for preparing Silsesquioxane Polymer A except that dimethyldimethoxysilane (20.0 g, 0.166 mol) was added to the ethanol solution after stirring the reaction mixture for 1 week. The reaction mixture was stirred for an additional 2 weeks before the 2% acid scavenger and 0.75% lithium iodide were added and the solutions filtered as described above.

Preparation of Silsesquioxane Polymer C:

The synthesis of a second preferred silsesquioxane was carried out similarly to the synthesis described above for preparing Silsesquioxane Polymer A except DMS-E12 was omitted from the reaction mixture.

Preparation of Acrylic Primer Polymer Latex:

The preparation of a preferred acrylic primer polymer latex was carried out as follows:

To a 2 liter three-neck round bottom flask fitted with a mechanical stirrer, condenser and a nitrogen inlet was added 400 ml of deionized water, 20 ml of a 10% weight/volume solution of sodium dodecylsulfate, 1 gram of sodium persulfate and 0.5 grams of sodium bisulfite while the reaction flask was stirred in a 72° C. water bath. An addition funnel containing 70 grams of methyl acrylate, 25 grams of methyl methacrylate and 5 grams of methacrylic acid was placed on the stirred flask and the monomers were added over a 2 hour period. The aqueous phase and the organic phase were purged with nitrogen prior to the monomer addition. The reaction mixture was initially a pale blue color and then became a translucent whitish-blue color. The reaction was allowed to stir overnight, the addition funnel was removed to vent unreacted monomers under a positive nitrogen flow for 50 minutes, and the reaction flask was removed from the water bath and cooled with tap water. The polymer latex was purified by dialysis against water for 3 days. A small portion of the latex sample was isolated for analysis by freeze drying to give a white solid. The resulting polymer had a $T_g$ of 35° C. (midpoint). Elemental Analysis for methyl acrylate/methyl methacrylate/methacrylic acid ratios of $69/25/6_{wt}$: Found (Calc.) C 56.63 (56.84) H 7.32 (7.28).

Coating of Silsesquioxane onto Photoconductor Layer:

Electrophotographic elements were prepared by coating a primer layer solution (as described above) onto the surface of a photoreceptor (photoconductor layer) at a web speed of about 6 m/min and a dryer temperature of 27° C. A sol-gel solution containing the silsesquioxane as described above was then coated onto this primer layer in a separate pass at a web speed of 3 m/min and using a drying profile of 104.5° C., 104.5° C., 82° C., 71° C. and 27° C. from the first to fifth dryers respectively. The resulting web was subsequently cut into sheets and cured at 82° C. for 24 hours. The cure of the resulting solid electrolyte layer was determined by Solid State $^{29}Si$ NMR spectra obtained using a Chemagnetics CMX-300 Solid State NMR Spectrometer operating at 59.5607 MHz on samples scraped off the coatings with a razor blade.

The following examples are meant for illustrative purposes, and not to be limiting of the invention in any manner.

Example 1: Lateral Image Spread Demonstration

The polymer latex described above was diluted to 4 weight % solids using methanol to produce a primer solution in a methanol/water solution (1:1 weight ratio). The resulting primer solution was coated onto a conventional negative charging photoreceptor at a web speed of about 6 m/min and a dryer temperature of 27° C. The thickness of the resulting coated layer ranged from 0.1 to 0.5 $\mu$m, but was typically 0.25 $\mu$m.

A plot of the lateral image spread (as "image width" in mm) vs. time after exposure (seconds) is shown in FIG. 1. The coating primer layer showed no image spreading at 55% relative humidity (RH, Curve A), and only slight image spread at 68% RH (Curve B).

Comparative Example 1: Lateral Image Spread Comparison

A sample of the polymer latex described above was diluted with water to 4 weight % solids and TRITON X-100 nonionic surfactant (0.1 weight %) was added thereto as described in Example 1 of U.S. Pat. No. 5,731,117 (noted above). The aqueous primer solution was coated onto positive charging photoreceptor as described above and the results are plotted as Curve C in FIG. 1. It can be readily seen that the polymer primer coating containing the TRITON X-100 nonionic surfactant showed a high rate of image spread at the 55% RH (Curve C), even as compared to the higher humidity measurement for the polymer primer coating described in Example 1 (Curve B).

Example 2: Adhesion of Silsesquioxane Overcoat With and Without Primer Layer In order to study the effects of the polymer primer layer in electrophotographic elements, an element of this invention (Invention) was prepared by coating a silsesquioxane polymer (4 $\mu$m dry coating thickness) as described above on a photoconductor layer that had been previously overcoated with a polymer primer layer as described above in Example 1. A Control element without a primer layer was similarly prepared and evaluated. The electrical properties of the silsesquioxane layer in the Control element were the same as those for the silsesquioxane layer in the Invention element.

The importance of the primer layer for the adhesion of the silsesquioxane layer to the photoconductor was demonstrated in an adhesive tape peel testing of samples of each element that had been incubated at high relative humidity. Adhesion testing at high humidity was carried out by placing the element samples in a chamber and periodically trying to remove the silsesquioxane layer by securing 810 SCOTCH brand Magic Tape to the outer element surface and pulling off the tape by hand. The surfaces of both the tape and element sample were then examined by eye for removed material. The initial conditions were room ambient temperature and relative humidity (RH) after which the samples were placed in a temperature humidity chamber (Hotpack Model 434304).

No overcoat delamination was observed for the Invention element after incubation for 1 week at 24° C. at 75% RH. The temperature and humidity were then increased to 35° C. and 85% RH and element samples were tested again for delamination after 9 days, after 15 days and after 26 days. No delamination was observed in any of the Invention element samples.

Comparative Example 2

Samples of the Control element were tested for delamination as described in Example 2. Delamination between the photoconductor layer and the outermost silsesquioxane layer was observed after only 9 days of incubation at 35° C. and 85% RH.

In summary, the results of these examples indicate that delamination between the photoconductor layer and the silsesquioxane layer in the Control element was observed after approximately 2 weeks at high humidity. No delamination was seen in the Invention element even after four weeks under the same conditions. Thus, the use of the noted primer layer between the photoconductor layer and the outermost silsesquioxane polymer layer is critical to element integrity upon storage especially after high humidity storage. However, it is also apparent that not just any primer layer will provide the desired adhesion and other imaging properties. Only if the primer layer is free of compounds containing ACTIVE groups that can migrate in the primer layer, such as the TRITON X-100 nonionic surfactant taught in the art, will image discrimination be acceptable.

The invention has been described in detail with particular reference to preferred embodiments thereof, but it will be understood that variations and modifications can be effected within the spirit and scope of the invention.

We claim:

1. An electrophotographic charge generating element comprising, in order:

(a) an electrically conductive layer, (b) a photoconductor charge generating layer, (c) a primer layer having a surface resistivity of at least $10^{10}$ ohms/square, and comprising an addition polymer that is coatable from a water-miscible, polar organic solvent, the primer layer containing substantially no free compounds that include ACTIVE groups, and (d) a solid electrolyte layer comprising a silsesquioxane salt complex.

2. The element of claim 1 wherein said silsesquioxane salt complex has a ratio of carbon to silicon atoms of at least 1.1:1.

3. The element of claim 1 wherein said solid electrolyte layer comprising said silsesquioxane salt complex further comprises a charge carrier.

4. The element of claim 3 wherein said charge carrier is LiCl, $CH_3COOLi$, $LiNO_3$, $LiNO_2$, LiBr, $LiN_3$, $LiBH_4$, LiI, LiSCN, $LiClO_4$, $LiCF_3SO_3$, $LiBF_4$, $LiBPh_4$, NaBr, $NaN_3$, $NaBH_4$, NaI, NaSCN, $NaClO_4$, $NaCF_3SO_3$, $NaBF_4$, $NaBPh_4$, KSCN, $KClO_4$, $KCF_3SO_3$, $KBF_4$, $KBPh_4$, RbSCN, $RbClO_4$, $RbCF_3SO_3$, $RbBF_4$, $RbBPh_4$, CsSCN, $CsClO_4$, $CsCF_3SO_3$, $CsBF_4$ or $CsBPh_4$ wherein "Ph" represents a phenyl group.

5. The element of claim 1 wherein said primer layer has a resistivity of at least $10^{14}$ ohms/square.

6. The element of claim 1 wherein said addition polymer has a glass transition temperature of at least 25° C.

7. The element of claim 6 wherein said addition polymer has a glass transition temperature of from about 30 to about 170° C.

8. The element of claim 1 wherein said addition polymer is an acrylic polymer.

9. The element of claim 8 wherein said addition polymer is prepared from any one or more of methyl acrylate, ethyl acrylate, methyl methacrylate, ethyl methacrylate, hydroxymethyl acrylate, acrylic acid, methacrylic acid, itaconic acid, styrene, vinyl toluene, acrylonitrile and isobutyl methacrylate.

10. The element of claim 9 wherein said addition polymer is a polymer prepared from one or more of methyl acrylate, methyl methacrylate, ethyl acrylate, ethyl methacrylate, acrylic acid and methacrylic acid.

11. The element of claim 10 wherein said addition polymer is a poly(methyl acrylate-co-methyl methacrylate-co-methacrylic acid).

12. The element of claim 1 wherein said primer layer comprises an addition polymer that is coatable from an aqueous alcoholic solution.

13. The element of claim 1 wherein said primer layer comprises an addition polymer that is coatable from an alcohol/ethyl acetate solution.

14. The element of claim 1 wherein said primer layer comprises an acrylic polymer that is coatable from an aqueous methanolic solution.

15. The element of claim 1 wherein said solid electrolyte layer comprises a silsesquioxane polymeric material selected from the group consisting of:

(a) a silsesquioxane represented by Structure I:

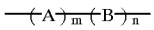

wherein -A- is represented by Structure Ia:

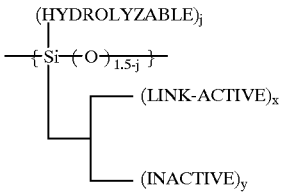

and -B- is represented by Structure Ib:

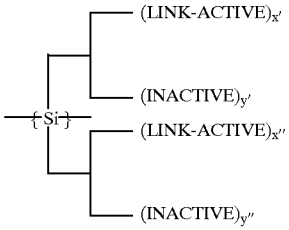

and (b) a mixture of polymers represented by Structures II and III:

II

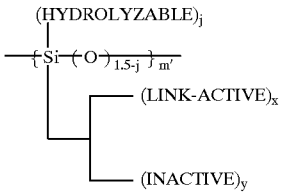

III

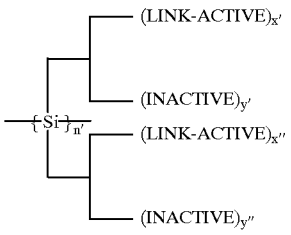

wherein $0 \leqq j \leqq 0.5$, m is from about 50 to 100 mole percent, n is from 0 to about 50 mole percent, m' is at least 10, and n' is at least 10, x+y, x'+y' and x"+y" are independently about 1, and (x+x'+x")/(x+y+x'+y'x"+y") is less than or equal to 0 45, HYDROLYZABLE is hydroxy, hydrogen, halo, an alkoxy group having 1 to 6 carbon atoms, an alylcarboxy group wherein the alkyl portion has 1 to 6 carbon atoms, an -(O—alkylene)$_p$—O—alkyl group wherein the alkylene portion is an alkylene group having 2 to 6 carbon atoms, the alkyl portion is an alkyl group having 1 to 6 carbon atoms and p is an integer of 1 to 3, or a primary or secondary amino group having 1 to 6 carbon atoms, LINK is an alkylene group having 1 to 12 carbon atoms, a fluoroalkylene group having 1 to 12 carbon atoms, a cycloalkylene group having 5 to 10 carbon atoms in the ring or an arylene group having 6 to 10 carbon atoms in the ring, ACTIVE is a monovalent organic group having from 4 to 20 carbon, nitrogen, oxygen or sulfur atoms, that can be complexed with a charge carrier, and INACTIVE is a monovalent or divalent group having from 1 to 12 carbon atoms that cannot participate in siloxane polycondensation and does not transport charge.

16. The element of claim 15 wherein said primer layer comprises up to 10 weight % of ACTIVE groups bound to said primer polymer.

17. The element of claim 1 wherein said silsesquioxane has at least 10 silyl units and is represented by Structure IV:

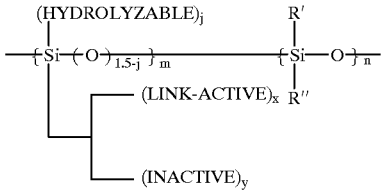

wherein $0 \leqq j \leqq 0.5$, m is from about 50 to 100 mole percent, n is from 0 to about 50 mole percent, x+y is about 1, x/(x+y) is less than or equal to 0.45, HYDROLYZABLE is hydroxy, hydrogen, halo, an alkoxy group having 1 to 6 carbon atoms, an alkylcarboxy group wherein the alkyl portion has 1 to 6 carbon atoms, an -(O—alkylene)$_p$—O—alkyl group wherein the alkylene portion is an alkylene group having 2 to 6 carbon atoms, the alkyl portion is an alkyl group having 1 to 6 carbon atoms and p is an integer of 1 to 3, or a primary or secondary amino group having 1 to 6 carbon atoms, R' and R" are independently alkyl groups having 1 to 10 carbon atoms or aryl groups having 6 to 10 carbon atoms, LINK is an alkylene group having 1 to 12 carbon atoms, a fluoroalkylene group having 1 to 12 carbon atoms, a cycloalkylene group having 5 to 10 carbon atoms in the ring or an arylene group having 6 to 10 carbon atoms in the ring, ACTIVE is a monovalent organic group having from 4 to 20 carbon, nitrogen, oxygen or sulfur atoms, that can be complexed with a charge carrier, and INACTIVE is a monovalent or divalent group having from 1 to 12 carbon atoms that cannot participate in siloxane polycondensation and does not transport charge.

18. The element of claim 17 wherein HYDROLYZABLE is hydroxy, R' and R" are both methyl, ethyl or phenyl, m is from about 50 to about 99 mole percent, and n is from about 1 to about 50 mole percent.

19. The element of claim 17 wherein the ACTIVE group further includes an oxy, thio, ester, imino or amino group.

20. A developed electrophotographic element comprising the electrophotographic charge generation element of claim 1 and a deposited image of electrophotographic toner.

21. An electrophotographic charge generating element comprising, in order:

(a) an electrically conductive layer, (b) a photoconductor charge generating layer, (c) a primer layer having a surface resistivity of at least $10^{10}$ ohms/square and comprising poly(methyl acrylate-co-methyl methacrylate-co-methacrylic acid) (70/25/5 weight ratio), the primer layer containing substantially no free compounds that include ACTIVE moieties, and (d) a solid electrolyte layer comprising a silsesquioxane salt complex.

22. The element of claim 21 wherein said silsesquioxane has at least 10 silyl units and is represented by Structure IV:

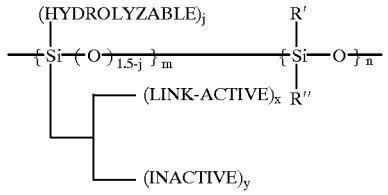

wherein $0 \leqq j \leqq 0.5$, m is from about 75 to 99 mole percent, n is from 1 to about 25 mole percent, x+y is about 1, x/(x+y) is less than or equal to 0.45, HYDROLYZABLE is hydroxy, hydrogen, halo, an alkoxy group having 1 to 6 carbon atoms, an alkylcarboxy group wherein the alkyl portion has 1 to 6 carbon atoms, an -(O—alkylene)$_p$—O—alkyl group wherein the alkylene portion is an alkylene group having 2 to 6 carbon atoms, the alkyl portion is an alkyl group having 1 to 6 carbon atoms and p is an integer of 1 to 3, or a primary or secondary amino group having 1 to 6 carbon atoms, R' and R" are independently alkyl groups having 1 to 10 carbon atoms or aryl groups having 6 to 10 carbon atoms, LINK is an alkylene group having 1 to 12 carbon atoms, a fluoroalkylene group having 1 to 12 carbon atoms, a cycloalkylene group having 5 to 10 carbon atoms in the ring or an arylene group having 6 to 10 carbon atoms in the ring, ACTIVE is a monovalent organic group having from 4 to 20 carbon, nitrogen, oxygen or sulfur atoms, that can be complexed with a charge carrier, and INACTIVE is a monovalent or divalent group having from 1 to 12 carbon atoms that cannot participate in siloxane polycondensation and does not transport charge.

23. The element of claim 22 wherein HYDROLYZABLE is hydroxy, R' and R" are both methyl, ethyl or phenyl, said ACTIVE group further includes an oxy, thio, ester, imino or amino group, and said silsesquioxane salt complex comprises a charge carrier that is LiCl, $CH_3COOLi$, $LiNO_3$, $LiNO_2$, LiBr, $LiN_3$, $LiBH_4$, LiI, LiSCN, $LiClO_4$, $LiCF_3SO_3$, $LiBF_4$, $LiBPh_4$, NaBr, $NaN_3$, $NaBH_4$, NaI, NaSCN, $NaClO_4$, $NaCF_3SO_3$, $NaBF_4$, $NaBPh_4$, KSCN, $KClO_4$, $KCF_3SO_3$, $KBF_4$, $KBPh_4$, RbSCN, $RbClO_4$, $RbCF_3SO_3$, $RbBF_4$, $RbBPh_4$, CsSCN, $CsClO_4$, $CsCF_3SO_3$, $CsBF_4$ or $CsBPh_4$ wherein "Ph" represents a phenyl group.

* * * * *